US006088943A

United States Patent [19]

Ramirez

[11] Patent Number: 6,088,943

[45] Date of Patent: Jul. 18, 2000

[54] DECORATIVE POP OUT CARD ACCESSORY FOR GIFTS

[75] Inventor: James R. Ramirez, Kansas City, Mo.

[73] Assignee: Hallmark Cards, Incorporated, Kansas City, Mo.

[21] Appl. No.: 09/162,809

[22] Filed: Sep. 29, 1998

[51] Int. Cl.[7] ..... G09F 3/18

[52] U.S. Cl. ..... 40/661.09; 40/124.01

[58] Field of Search ..... 40/124.01, 312, 40/661.09, 648, 424, 538, 594, 645

[56] References Cited

U.S. PATENT DOCUMENTS

| | | | |
|---|---|---|---|
| D. 291,898 | 9/1987 | Smith . | |
| D. 350,371 | 9/1994 | Rayle . | |
| 664,517 | 12/1900 | Webb | 40/312 X |
| 1,736,583 | 11/1929 | Dieke . | |
| 1,792,572 | 2/1931 | Buswell . | |
| 2,363,438 | 11/1944 | Popper | 40/424 |
| 2,736,115 | 2/1956 | James | 40/312 |
| 2,810,176 | 10/1957 | Gaafar | 40/645 X |
| 2,835,994 | 5/1958 | Kuefner | 40/645 |
| 3,235,986 | 2/1966 | Blish . | |
| 3,235,988 | 2/1966 | Paige . | |
| 3,427,642 | 2/1969 | Mohr . | |
| 4,294,350 | 10/1981 | Haase et al. . | |
| 4,299,041 | 11/1981 | Wilson . | |
| 4,379,797 | 4/1983 | Cole . | |
| 4,763,427 | 8/1988 | Schrager | 40/539 X |
| 4,774,780 | 10/1988 | Crowell . | |
| 4,779,733 | 10/1988 | Kilian | 40/312 X |
| 5,156,893 | 10/1992 | Barthe . | |
| 5,613,312 | 3/1997 | Crowell | 40/312 |

*Primary Examiner*—Joanne Silbermann
*Attorney, Agent, or Firm*—Leydig, Voit & Mayer, Ltd.

[57] ABSTRACT

A decorative accessory includes an adhesive attachment tab connected by formable wire segments to at least two cards. The formable wire may be formed into a desired shape by hand to extend outward from the attachment tab in a cantilever fashion. The adhesive attachment tab can be secured to gift packages or gift bags. The cards are highly visible when the wire is formed into a selected shape. One of the cards may announce the special occasion for the gift while the other card may announce who the gift is from. A bow or other decoration may be attached to the attachment tab to increase the aesthetics.

3 Claims, 3 Drawing Sheets

DECORATIVE POP OUT CARD ACCESSORY FOR GIFTS

FIELD OF THE INVENTION

The present invention relates to the art of decorative accessories, and more particularly to decorative cards for such things as gift packages, gift bags and the like.

BACKGROUND OF THE INVENTION

Decorative accessories such as cards are used in the art of gift packaging for decorative purposes and/or to convey messages to the receiver of a gift. Cards are typically enclosed in an envelope that is attached to the wrapping of a package or inserted freely into a gift bag. Adhesive labels that stick directly on the gift wrapping of a package are another form of decorative accessory that has been used to convey messages. When conveying messages to the receiver of a gift, it is conventional to provide a message announcing the special occasion for the gift and a message indicating who the gift is from.

SUMMARY OF THE INVENTION

The decorative accessory of the present invention is highly suited for use as the card for such things as gift bags and gift packages. The decorative accessory of the present invention includes an attachment tab having an adhesive face or other attachment means for securing the decorative accessory to a gift bag or package. One or more cards are connected by corresponding segments of formable wire material to the attachment tab. The formable wire segments can be formed manually by hand into a desired ornamental shape. The attachment tab supports the wire segments and cards in a cantilever fashion when the attachment tab is secured to a gift package or bag.

An advantage of the preferred embodiment is that the cards can be selectively positioned to project outward from the gift and therefore provide a more visible message. Preferably, a first card can announce the special occasion for the gift and a second card can announce who the gift is from. Another advantage of the preferred embodiment is that the decorative accessory can be folded and tightly packed together thereby minimizing shipping costs. In particular, the formable wire can be folded so that the cards and attachment tab lie flat against one another during shipment. After shipment, the formable wire material allows the cards to be selectively positioned after shipment. Additional decorative material such as a bow may be attached to the attachment tab to cover the attachment tab and increase the ornamental presentation.

These and other features of the invention will become more apparent from the following detailed description when taken in conjunction with the accompanying drawings.

Figure 1:
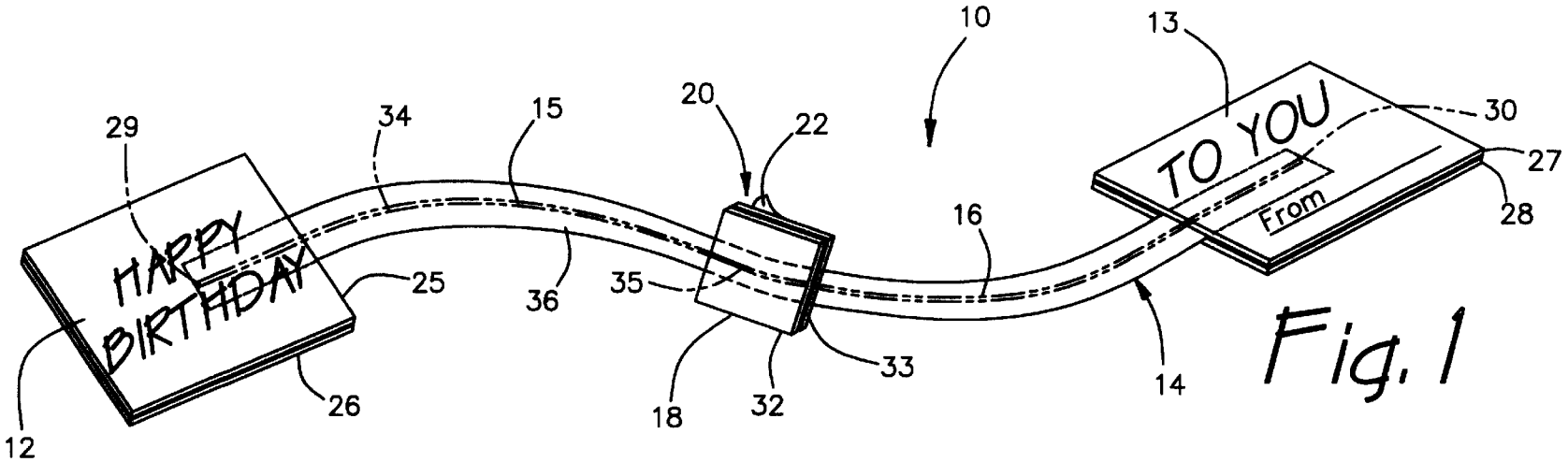
FIG. 1 is a frontal perspective view of a decorative accessory according to a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to FIG. 1, a preferred embodiment of a decorative accessory 10 is shown in accordance with the present invention. The decorative accessory 10 generally includes at least one and preferably two or more cards 12, 13 connected by formable wire segments 15, 16 to an attachment tab 18 or other securing means. The individual wire segments 15, 16 are preferably of about equal length and extend outward from the attachment tab 18. Each wire segment 15, 16 is connected to and carries a corresponding card 12, 13.

Figure 3:
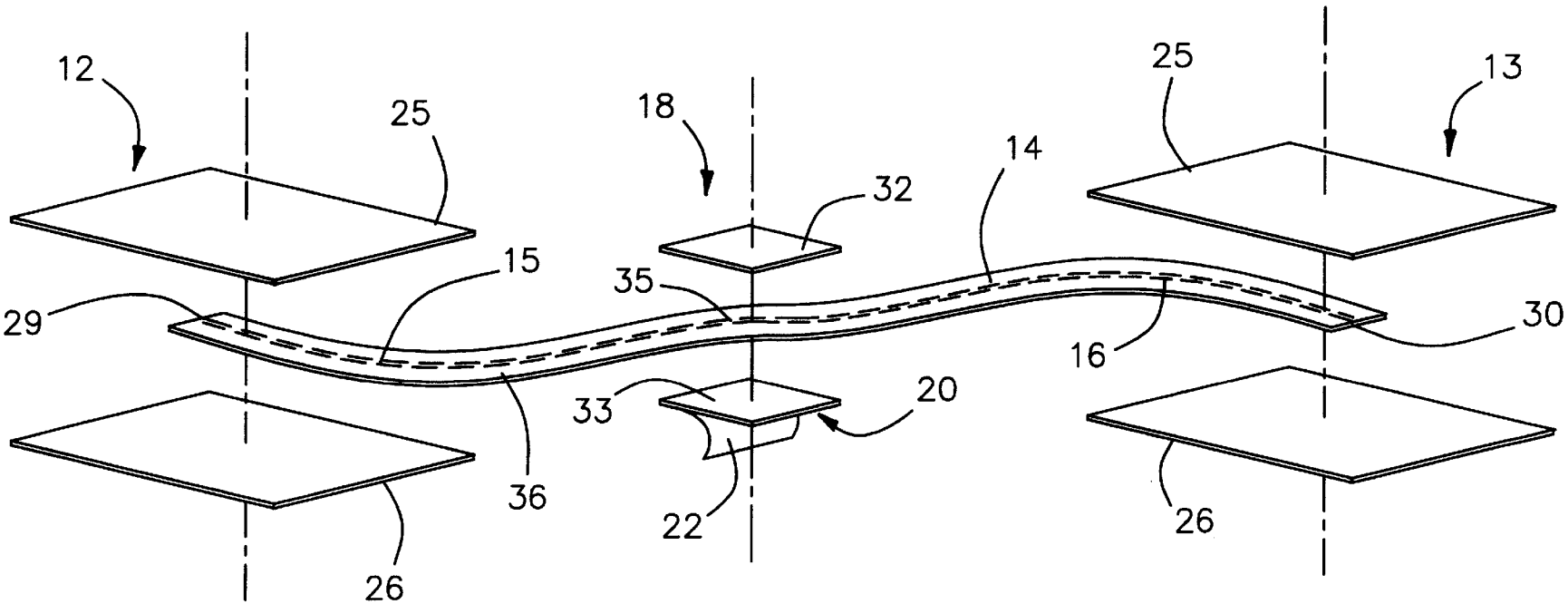
FIG. 3 is a perspective rear view of the decorative accessory shown in FIG. 1.
Figure 4:
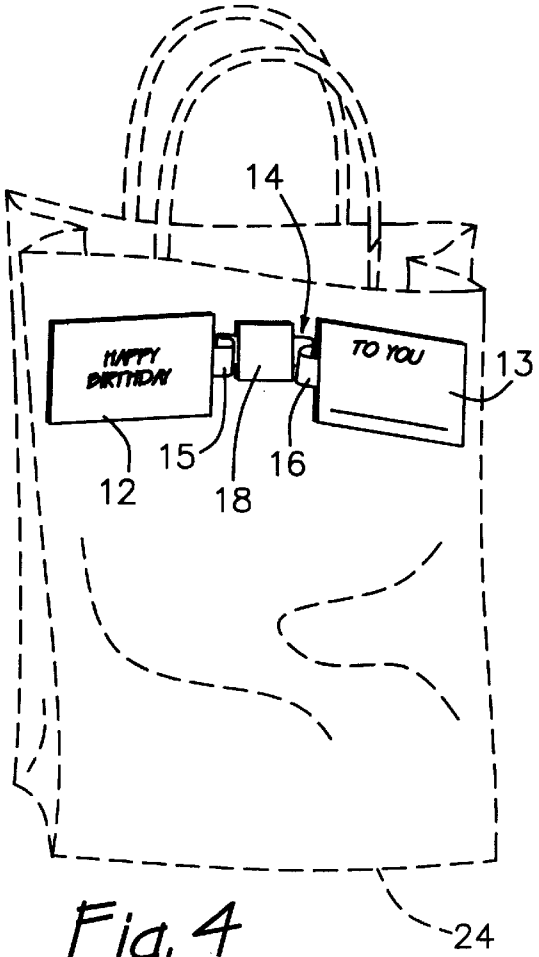
FIG. 4 is a perspective view of the decorative accessory of FIG. 1 affixed to an exemplary gift bag in a manually formed shape.

As shown in FIG. 3, the attachment tab 18 preferably includes an adhesive face 20 that is preferably covered by a removable pull-off strip 22 to protect the adhesive during handling and shipping while permitting easy removal during use. The strip 22 can be removed to expose the adhesive face 20 when it is desired to attach the accessory 10 to a gift bag or package. As shown in FIG. 4, the adhesive face 20 of the attachment tab 18 can be affixed to the gift bag 24 or other gift package to secure the decorative accessory 10 thereto. When the attachment tab 18 is secured to a gift bag 24 or package, the formable wire segments 15, 16 and the cards 12, 13 extend outward from and are cantilevered to the attachment tab 18.

The formable wire material used for segments 15, 16 is sufficiently flexible such that it may be formed into a desired shape by hand, thereby locating the cards 12, 13 in a desired location relative to the gift bag 24. However, the formable wire material is also rigid enough to maintain substantially the same shape as the manually formed shape. The formable wire material is also sufficiently durable such that the wire segments 15, 16 may be reformed in different shapes many times over as desired until the desired appearance for the decorative accessory 10 is achieved.

Figure 5:
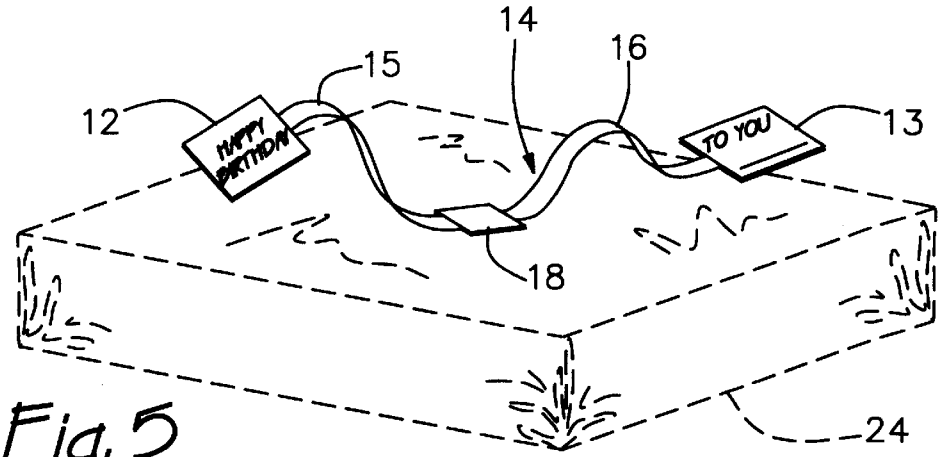
FIG. 5 is a perspective view of a preferred embodiment affixed to an exemplary gift package.
Figure 6:
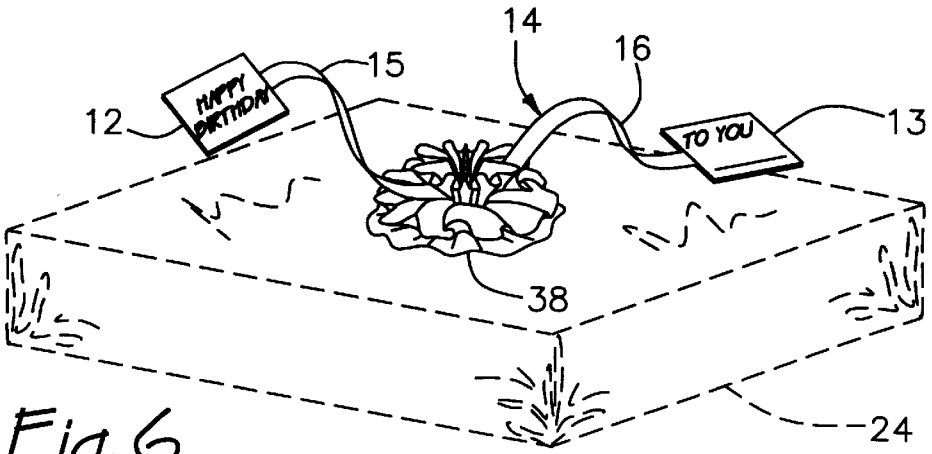
FIG. 6 is an alternative preferred embodiment of the present invention affixed to an exemplary gift package.

Advantageously, the cards 12, 13 can project outward from the gift as shown in FIG. 4 and are therefore highly visible. Depending upon the desired shape of the formed wire segments 15, 16, the strength of the wire segments used, and the weight of the cards 12, 13, the cards 12, 13 maybe supported solely by the wire segments 15, 16 or supported by the wire segments 15, 16 with an edge of the cards resting on a surface of the gift bag 24 or package. When the attachment tab 18 is affixed to a gift bag 24 or package, the weight of the cards 12, 13 may tend to bend the wire segments 15, 16. However, the wire segments 15, 16 are sufficiently rigid to substantially maintain the desired shape so that the cards "pop-out" from the gift bag 24 or package as shown in FIGS. 4, 5, and 6. The formable wire material allows the decorative assembly 10 to be folded up for shipment with the cards 12, 13 and attachment tab 18 lying flat against one another, thereby minimizing shipping costs. The wire segments 15, 16 can then be easily shaped as desired after shipment.

Figure 2:
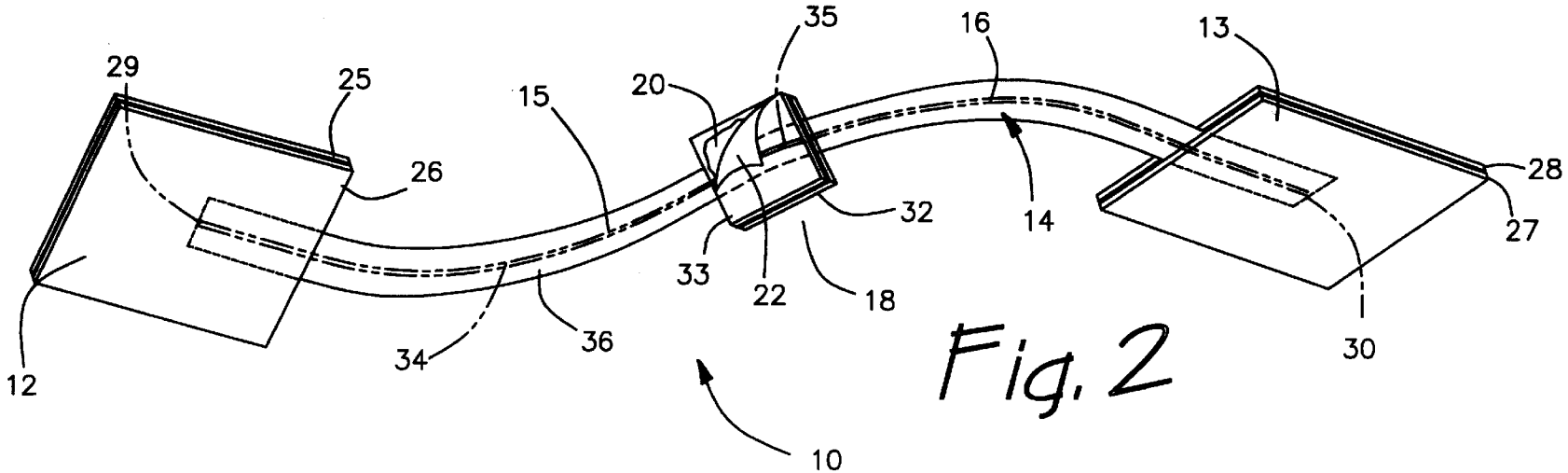
FIG. 2 is an exploded perspective view of the decorative accessory shown in FIG. 1.

As exemplified in FIG. 2, each card 12, 13 is constructed of one or more; and, preferably, two mating sheets 25, 26, 27, 28 joined together with ends 29, 30 of the wire segments 15, 16 hidden therebetween to thereby connect the formable wire to the cards 12, 13. Preferably the mating sheets are joined using adhesive although other alternatives, such as staples, are workable. Such construction hides the wire ends 29, 30 and therefore improves the overall appearance. Alternatively, the cards 12, 13 may be unitarily formed by a single sheet and may be connected to the formable wire by staples, tape, suitable adhesive, or other suitable means that suggests itself.

The cards 12, 13 are preferably formed of paper material such as paper or paperboard, but may also be formed of plastic, or fabric, or other material that suggests itself. The cards 12, 13 are preferably planar or two dimensional for readily displaying a message and other graphics. Alternatively, the cards 12, 13 may have three dimensional or textured shapes and/or have decorative ornaments attached thereto. Various different shapes and sizes can be used for the cards 12, 13. However, the cards 12, 13 are preferably sized several times smaller than the anticipated size of the gift bag or package, and have a flat surface area on one side of any suitable amount and preferably between about four and five square inches. In one preferred embodiment of the invention, one card 12 displays indicia identifying the special occasion for the gift, while the other card 13 displays indicia identifying the gift given.

Similar to the cards, the attachment tab 18 can also be fabricated from two separate mating sheets 30, 32 joined together with the wire segments 15, 16 attached therebetween. Preferably the mating sheets are joined using adhesive although other alternatives, such as staples, are workable. Preferably, the wire segments 15, 16 are formed from a single continuous strand 14 of wire that has an intermediate wire segment 35 running between the two sheets 30, 32. This provides a relatively sturdy and cheap fabrication for the connection between the attachment tab 18 and the wire segments 15, 16. While the formable wire segments 14, 15 are preferably part of a continuous strand 14 of wire, they can also be discontinuous or cut into two separate pieces.

Alternatively, the attachment tab 18 may be unitarily constructed from a single sheet and may be connected to the formable wire 14 by weaving or looping the wire through holes in the attachment tab or by staples, tape, suitable adhesive, or other such suitable means that suggests itself. The attachment tab 18 is preferably formed of paper material such as paper or paperboard, but may also be formed of plastic, or fabric, or other suitable material that suggests itself.

The formable wire 14 may be formed from thin metal wire 34 encased in plastic material 36 as illustrated in the drawings or thin metal wire encased in paper material, thin metal wire, pipe cleaner, or other suitable material that suggests itself. The formable wire material is sufficiently flexible to be easily formed by hand but rigid enough to substantially maintain a desired manually formed shape while supporting the cards 12, 13 from the attachment tab 18 in a cantilever fashion as shown in FIG. 4. Each wire segment 15, 16 has an exposed length preferably between about 1¼" and 1½" inches. The wire preferably is formed from a round wire although flat or square shaped wire may be used.

The attachment tab 18 can be secured to gifts such that the wire segments 15, 16 and cards 12, 13 project horizontally outward as shown in FIG. 4 or vertically upward when secured to a package as shown in FIG. 5. To support the decorative accessory 10 in the horizontal position shown in FIG. 4, the adhesive face 20 of attachment tab 18 is large enough and has sufficient adhesive strength to hold the formable wire segments 15, 16 and cards 12, 13 in a cantilever fashion and horizontally outward when secured to a gift. One suitable adhesive is Findley Adhesives H2091 brand adhesive having a tackiness of 650 grams/cm2 as measured by polyken probe, but a wide array of adhesives may be used.

Turning to FIG. 6, it will be appreciated that decorative ornaments such as a bow 38, may be secured to the attachment tab 18 by staples, tape, suitable adhesive, or any other appropriate connection means. The bow 38 hides attachment tab 18 thereby increasing the overall aesthetic appeal. As used herein bow material includes gathered paper material sheets, ribbon, or any other decorative ornamental material that suggests itself. The exemplary decorative bow 38 illustrated in FIG. 6 is the same as that disclosed in my pending U.S. patent application Ser. No. 09/158,129 filed Sep. 22, 1998 entitled Decorative Bow, the entire disclosure of which is hereby incorporated by reference.

From the foregoing description and examples, it is apparent that the objects of the present invention have been achieved. While only certain embodiments have been set forth, alternative embodiments and various modifications will be apparent to those skilled in the art. These and other alternatives are considered equivalents and within the spirit and scoped of the present invention.

What is claimed is:

1. A decorative accessory for gift packages and bags, comprising:

at least two cards;

an attachment tab having an adhesive face;

at least two segments of formable wire material, the formable wire material being sufficiently flexible to be formed into a shape manually by hand and rigid enough to maintain a manually formed shaped, each segment connected to the attachment tab and carrying one of said cards; and each card comprises two paper material sheets glued together, the ends of said wire segments being secured between the glued paper material sheets.

2. The decorative accessory of claim 1 wherein the attachment tab comprises two paper material sheets glued together, the formable wire segments being integrally connected by an intermediate wire segment, the intermediate wire segment running between the glued paper material sheets to thereby secure the attachment tab to the formable wire segments.

3. A decorative accessory for gift packages and bags, comprising:

first and second cards;

a continuous strand of formable wire material, the formable wire material being sufficiently flexible to be formed into a shape manually by hand and rigid enough to maintain a manually formed shaped, having a first end connected to the first card and a second end connected to the second card;

means connected to the formable wire for securing the decorative accessory to a gift wherein the formable wire material and cards extend outward from the gift in a cantilever fashion;

said securing means comprises an attachment tab having an adhesive face; and said attachment tab including two paper material sheets glued together, the formable wire being a continuous strand and running between the glued paper material sheets to thereby secure the attachment tab to the formable wire, one of the paper material sheets having an exposed adhesive face.

* * * * *